US006853266B2

(12) United States Patent
Miyamoto

(10) Patent No.: US 6,853,266 B2
(45) **Date of Patent: *Feb. 8, 2005**

(54) DIELECTRIC FILTER, DIELECTRIC DUPLEXER, AND COMMUNICATION DEVICE

(75) Inventor: Hirofumi Miyamoto, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/752,577

(22) Filed: Jan. 8, 2004

(65) Prior Publication Data

US 2004/0140867 A1 Jul. 22, 2004

Related U.S. Application Data

(62) Division of application No. 10/013,775, filed on Dec. 11, 2001.

(30) Foreign Application Priority Data

Dec. 22, 2000 (JP) ..... 2000-391399

(51) Int. Cl.[7] ..... H01P 5/12; H01P 1/20

(52) U.S. Cl. ..... 333/134; 333/202; 333/206

(58) Field of Search ..... 333/134, 206, 333/222, 202, 207, 223

(56) References Cited

U.S. PATENT DOCUMENTS 5,945,896 A * 8/1999 Miyamoto ..... 333/206
6,433,651 B1 * 8/2002 Kuroda et al. ..... 333/134
6,580,339 B2 * 6/2003 Kuroda ..... 333/134

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

Resonator holes are provided so as to extend between opposing surfaces of a dielectric filter. At least one of the resonator holes have large-diameter hole portions, and small-diameter hole portions communicating with the large-diameter hole portions, respectively. The small-diameter hole portions are provided in one of the opposing surfaces. The axes of the small-diameter hole portions and the axes of the large-diameter hole portions are displaced, respectively, such that the displacement distance P therebetween is within a range which satisfies the relationship R−r<P<R+r, where R is the radii of the large-diameter hole portions and r is the radii of the small-diameter hole portions. The large-diameter hole portions and the small-diameter hole portions overlap each other in the axial directions of the resonator holes.

18 Claims, 13 Drawing Sheets

DIELECTRIC FILTER, DIELECTRIC DUPLEXER, AND COMMUNICATION DEVICE

This is a division of application Ser. No. 10/013,775, filed Dec. 11, 2001, which is hereby incorporated herein by reference.

BACKGROUND OF THE INVENTION

1. Field of the Invention

The present invention relates to a dielectric filter, a dielectric duplexer, and a communication device.

2. Description of the Related Art

A known dielectric filter in which a plurality of dielectric resonators are provided in a dielectric block is shown in FIG. 20. The dielectric filter 200 is formed in a dielectric block 201 having a generally parallelepiped shape. A pair of resonator holes 202*a* and 202*b* are formed in the dielectric block, each hole extending between opposing surfaces 200*a* and 200*b* of the dielectric block. The resonator holes 202*a* and 202*b* have large-diameter hole portions 222*a* and 222*b*, and small-diameter hole portions 223*a* and 223*b* communicating with the large-diameter hole portions 222*a* and 222*b*, respectively.

As best shown in FIG. 21, the end walls 224*a* and 224*b* of the large-diameter hole portions 222*a* and 222*b* and end walls 225*a* and 225*b* of the small-diameter hole portions 223*a* and 223*b* are formed in a common plane. The axes of the small diameter hole portions 223*a* and 223*b* are displaced from those of the large diameter hole portions 222*a* and 222*b* with the result that relatively small communication areas b are formed between the respective large and small diameter hole portions.

An outer conductor 204 is formed on five of the six outer surfaces of the dielectric block. The front surface 200*a* is not plated. A pair of input/output electrodes 205 are formed on the outer surface of the dielectric block 201 and are spaced from the outer conductor 204 so as to be electrically isolated therefrom. Inner conductors 203 are formed on the entire inner surface of each of the resonator holes 202*a* and 202*b*. The end of the inner conductors 203 located at the front surface 200*a* of the dielectric block is electrically open (i.e., spaced from, and thereby isolated from, the outer conductor 204). The end of the inner conductors 203 located at the rear surface 200*b* is short-circuited (physically connected) to the outer conductor 204.

The outer conductor 204 and inner conductors 203 are typically formed on the dielectric block 201 by wet plating. However, with wet plating, the plating liquid in the vicinity of a surface to be plated must be circulated so that new plating liquid is constantly supplied to the surface. To this end, plating liquid is typically stirred or the workplace is moved in the plating liquid to promote the circulation of the plating liquid.

As best shown in FIG. 21, the connection portions b between the large and small diameter portions are narrow. This results in poor penetration of the plating liquid through the resonator holes 202*a* and 202*b*, and thus results in a smaller supply of new plating liquid and insufficient plating. With this arrangement, therefore, it is difficult to provide the desired film thickness for the inner conductor 203 to be formed on the inner surface of the resonator holes 202*a* and 202*b*.

SUMMARY OF THE INVENTION

An object of the present invention is to provide a dielectric filter, dielectric duplexer, and communication device, which allow the formation of an inner conductor on the inner surfaces of resonator holes with sufficient thickness and stability.

To this end, according to a first aspect of the present invention, there is provided a dielectric filter includes a dielectric block having a plurality of resonator holes therein, an inner conductor formed on the inner surface of each of the resonator holes, and an outer conductor formed on the outer surface of the dielectric block. At least one of the resonator holes comprises a large-diameter hole portion and a small-diameter hole portion communicating with the large-diameter hole portion. The axis of the large-diameter hole portion and the axis of the small-diameter hole portion are displaced from each other so that the at least one of the resonator holes has a bent shape. The large-diameter hole portion and the small-diameter hole portion overlap each other along their respective axial directions.

With this arrangement, the connection portion of the large-diameter hole portion and the small-diameter hole portion is larger in cross section (as measured along a plane lying perpendicular to the main direction of flow of plating liquid through the connection portion) than the connection portion of the known resonator hole, thereby improving the passage of plating liquid through the resonator hole. As a result, it is easier to ensure that the film thickness of the inner conductor of the large-diameter hole portion and the small-diameter hole portion is at desired levels, thus allowing an increase of the Q-value of the resonator. This makes it possible to broaden the passband of the dielectric filter and to facilitate the achievement of the small-sized dielectric filter having an acute attenuation characteristic and high performance.

Preferably, the dielectric filter includes at least two bent resonator holes located adjacent one another and the interaxial distance between the small-diameter hole portions of two adjacent resonator holes is greater than, equal to, or smaller than the interaxial distance between the large-diameter hole portions thereof.

According to a second aspect of the present invention, there is provided a dielectric duplexer. The dielectric duplexer which includes the dielectric filter according to the first aspect of the present invention.

According to a third aspect of the present invention, there is provided a communication device which includes a dielectric duplexer according to the second aspect of the present invention.

Since the dielectric duplexer and the communication device according to the present invention include the dielectric filter having the above-mentioned features, they can provide improved electric characteristics similar to those of the dielectric filter of the present invention.

BRIEF DESCRIPTION OF THE DRAWINGS

Other features and advantages of the present invention will become apparent from the following description of the invention which refers to the accompanying drawings.

DETAILED DESCRIPTION OF EMBODIMENTS OF THE INVENTION

Figure 1:
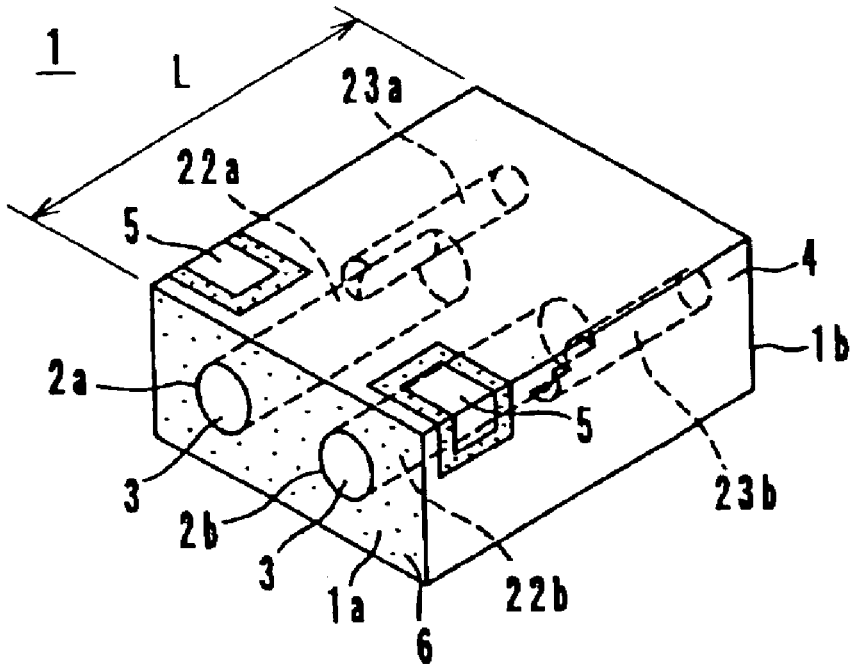
FIG. 1 is a perspective view of a dielectric filter according to a first embodiment of the present invention.
Figure 2:
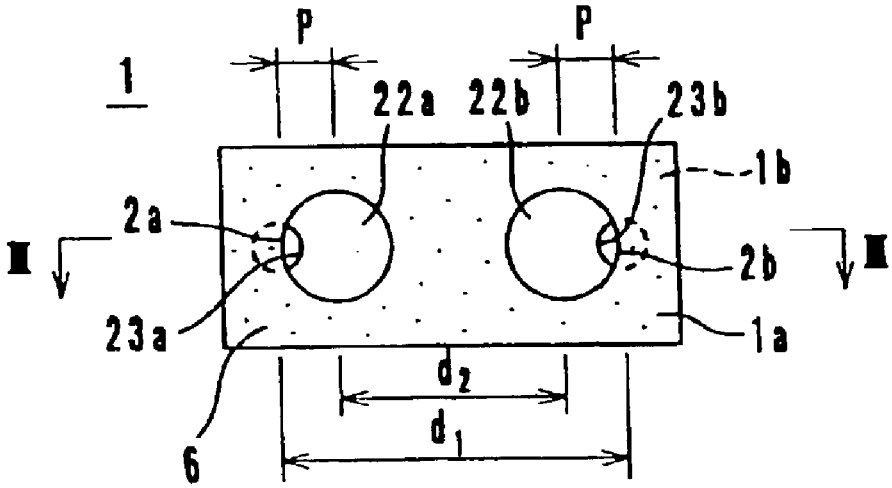
FIG. 2 is a front view of the dielectric filter, viewed from the side of an open-circuited end surface, according to the first embodiment.

A dielectric filter, a dielectric duplexer, and a communication device according to embodiments of the present invention will be described below with reference to the appended drawings. Throughout the embodiments, like elements and like portions are denoted with the same reference numerals and the description thereof will be omitted for simplicity.

First Embodiment

A first embodiment of the present invention will now be described with reference to FIGS. 1 to 7. Referring first to FIG. 1, a dielectric filter 1 according to a first embodiment of the present invention has a pair of resonator holes 2*a* and 2*b* each extending between opposing surfaces 1*a* and 1*b* of the dielectric filter 1. The resonator holes 2*a* and 2*b* include large-diameter hole portions 22*a* and 22*b*, preferably having circular cross-sections, and small-diameter hole portions 23*a* and 23*b*, also preferably having circular cross-sections, and communicating with the large-diameter hole portions 22*a* and 22*b*, respectively. The distance $d_1$ (FIG. 2) between the central axes of the small-diameter hole portions 23*a* and 23*b* is greater than the distance $d_2$ between the central axes of the large diameter hole portions 22*a* and 22*b* with the result that the axes of the small-diameter hole portions 23*a* and 23*b* are displaced from those of the large-diameter hole portions 22*a* and 22*b*, respectively, by a displacement distance P. The displacement distance P falls within a range $R-r<P<R+r$, where R is the radii of the large-diameter hole portions 22*a* and 22*b* and r is the radii of the small-diameter hole portions 23*a* and 23*b*. Thus, the resonator holes 2*a* and 2*b* have bent (non-aligned) shapes and will be referred to herein as bent resonator holes.

As shown in FIG. 1, an outer conductor 4 and a pair of input/output electrodes 5 are formed on the outer surface of the dielectric filter 1 (on the outer surface of the dielectric block 6 in which the filter is formed). The input/output electrodes 5 are spaced from the outer conductor 4 so as to be electrically isolated therefrom. The outer conductor 4 is located on almost the entire outer surface of the dielectric block 6, but not in the regions in which the input/output electrodes 5 are formed and not on the open-circuited end surface 1*a*. Inner conductors 3 are formed on the entire inner surfaces of the resonator holes 2*a* and 2*b*. The inner conductors 3 are electrically open (i.e., isolated from the outer conductor 4) at the open-circuited end surface 1*a*, and are short-circuited (i.e., connected to the outer conductor 4) at the short-circuited end surface 1*b*. In addition, the axial length L of the resonator holes 2*a* and 2*b* is designed to be about $\lambda/4$ (where $\lambda$ is the center wavelength of the resonators corresponding to the resonator holes 2*a* and 2*b*). External coupling capacitance is provided between respective inner conductors 3 of the resonator holes 2*a* and 2*b* and the input/output electrodes 5.

Figure 3:
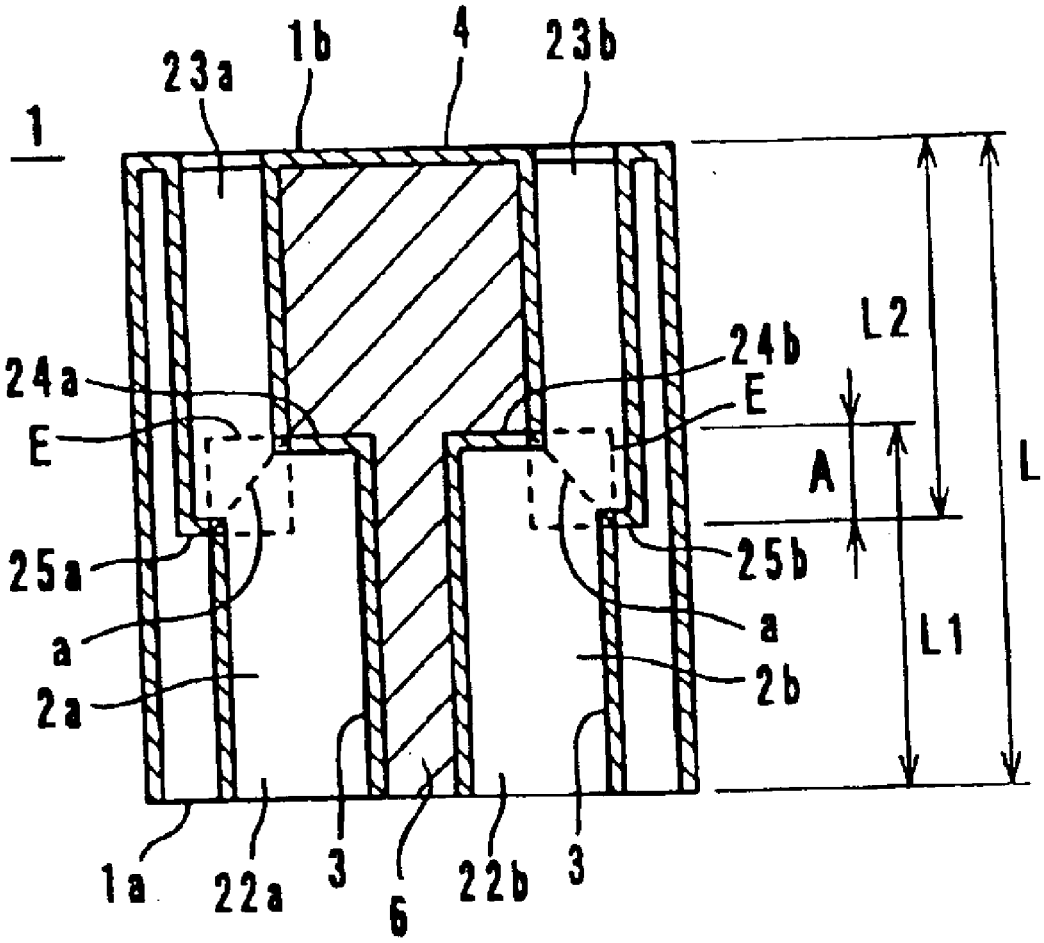
FIG. 3 is a sectional view of the dielectric filter, taken along line III—III, according to the first embodiment.
Figure 21:
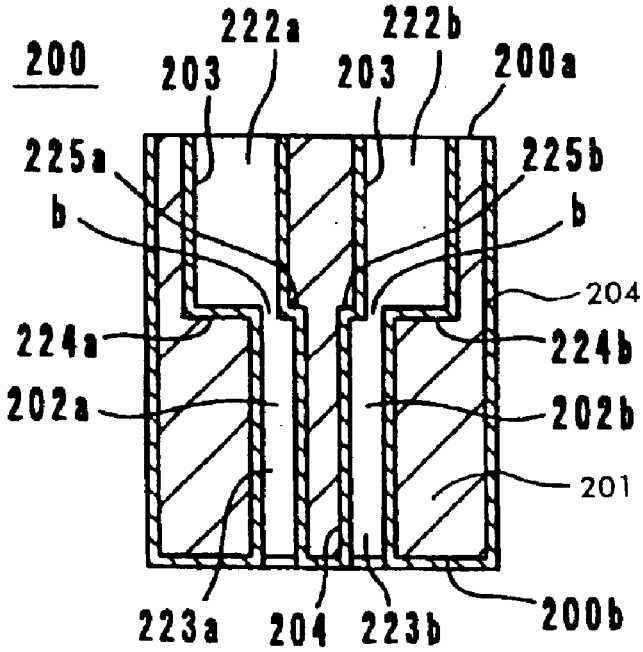
FIG. 21 is a sectional view of the dielectric filter, taken along XXI—XXI, of the known art.

Referring now to FIG. 3, the large-diameter hole portions 22*a* and 22*b* and the small-diameter hole portions 23*a* and 23*b* overlap each other in the axial directions of the resonator holes 2*a* and 2*b* in the regions indicated by dotted lines E. That is, the combined length of the large-diameter hole portions 22*a* and 22*b* (the axial length L1 from the surface 1*a* to end walls 24*a* and 24*b* of the large-diameter hole portions 22*a* and 22*b*) and the small-diameter hole portions 23*a* and 23*b* (the axial length L2 from the surface 1*a* to end walls 25*a* and 25*b* of the small-diameter hole portions 23*a* and 23*b*) is longer than a length L of the resonator holes 2*a* and 2*b* (the length from the surface 1*a* to the surface 1*b*) by an overlapping length A. As a result, the length a of the cross-sections of the connection portions as measured along a plane lying perpendicular to the main direction of flow of plating liquid through the connection portion is larger than the length of the corresponding connection portions b of the known dielectric filter (see FIG. 21). Thus, the resonator holes 2*a* and 2*b* have shapes which facilitate the passage of plating liquid therethrough, and it is possible to form inner conductor 3 with a constant desired thickness. As a result, the dielectric filter 1 can have an improved Q-value compared to the prior art filter.

The interaxial distance d2 between the axes of the large-diameter hole portions 22*a* and 22*b* of the resonator holes 2*a* and 2*b* is selected by the designer of the filter primarily as a function of the number of resonator holes to be formed in the dielectric block. Thereafter, the designer selects the degree of offset of the small-diameter hole portions to adjust the coupling between adjacent resonators. Because the interaxial distance d1 between the small-diameter hole portions 23*a* and 23*b* (located at the side of the short-circuited end surface 1*b*) is greater than the interaxial distance d2 between the large-diameter hole portions 22*a* and 22*b*, the magnetic field energy ratio between the adjacent resonators is decreased and the capacitive coupling between adjacent resonators is increased. Thus, stronger capacitive coupling is provided between two resonators formed with the resonator holes 2*a* and 2*b*. With this arrangement, a dielectric filter 1 having stronger capacitive coupling can be provided without changing the external shape or the dimensions thereof.

Figure 4:
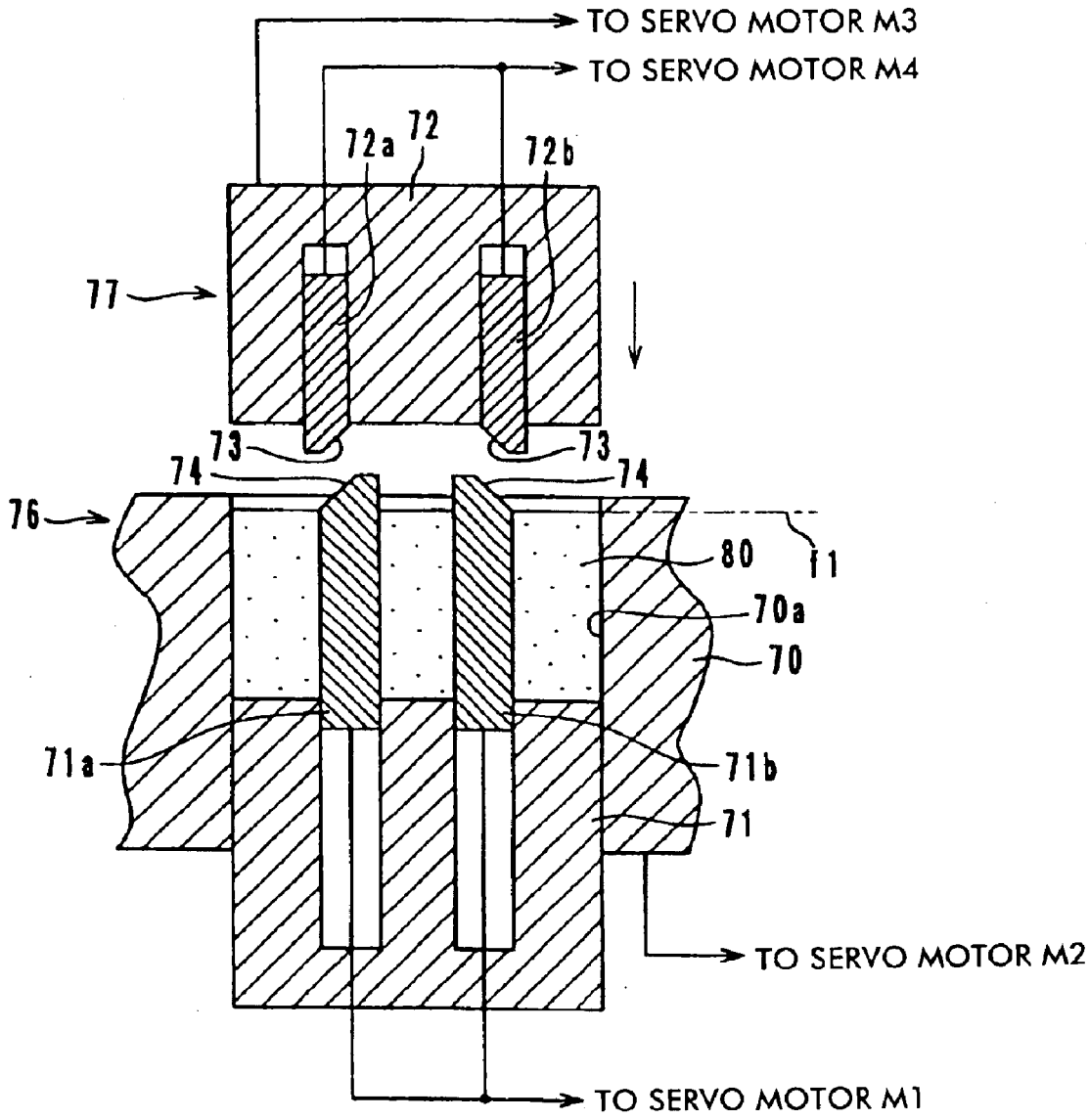
FIG. 4 is a schematic vertical sectional view illustrating a method for press molding of the dielectric filter according to the first embodiment.

Now, an example of a method of forming the dielectric block of the dielectric filter 1 by press molding will be described with reference to FIGS. 4 to 7. As shown in FIG. 4, the press molding machine has a lower die 76 and an upper die 77. The lower die 76 is provided with a die 70, a lower punch 71, and lower core bars 71*a* and 71*b* which are slidable relative to the lower punch 71. The die 70 has a cavity 70*a* with a rectangular cross-section, and the lower punch 71 is fitted into the cavity 70*a*. The lower core bars 71*a* and 71*b* have substantially the same shape and size as the large-diameter hole portions 22*a* and 22*b*, respectively, and have cylindrical shapes with radii R. The upper die 77 is provided with an upper punch 72, and upper core bars 72*a* and 72*b* which are slidable relative to the upper punch 72. The upper core bars 72*a* and 72*b* have substantially the same shapes and size as the small-diameter hole portions 23*a* and 23*b*, respectively, and have cylindrical shapes with radii r. Inclined portions 73 are formed at the lower ends of the upper core bars 72*a* and 72*b*, and inclined portions 74 are formed on the upper ends of the lower core metals 71*a* and 71*b*, respectively.

The positions of the lower die 71 and the upper die 77 are independently servo-controlled. AC servo motors M1, M2, M3, and M4 are utilized to actuate (lift and lower) the lower core bars 71*a* and 71*b*, the die 70, the upper punch 72, and the upper core bars 72*a* and 72*b*, respectively. With the upper surface of the lower punch 71 being a reference surface, the position of the lower surface of the upper punch 72, the positions of lower surfaces of the upper core bars 72*a* and 72*b*, the upper surfaces of the lower core bars 71*a* and 71*b*, and the distance of the upper surface of the die 70 from the reference surface are measured on a linear scale (not shown). The AC servo motors M1 to M4 are numerically controlled on the basis of each piece of the measured positional information.

In operation, the inclined portions 74 of the lower core bars 71*a* and 71*b* are first lifted to a position higher than a surface f1, the cavity 70*a* is filled with a predetermined amount of dielectric powder 80, and then the upper die 77 is lowered. Once the upper die 77 reaches a position where inclined portions 73 of the upper core bars 72*a* and 72*b*, respectively, come into contact with the inclined portions 74 of the lower core bars 71*a* and 71*b*, the lowering of the upper die 77 stops. In the subsequent process, the contacts between the inclined portions 73 of the upper core bars 72*a* and 72*b* and the inclined portions 74 of the lower core bars 71*a* and 71*b* form the connection portions a, shown in FIG. 3, of the resonator holes 2*a* and 2*b*, respectively.

Figure 5:
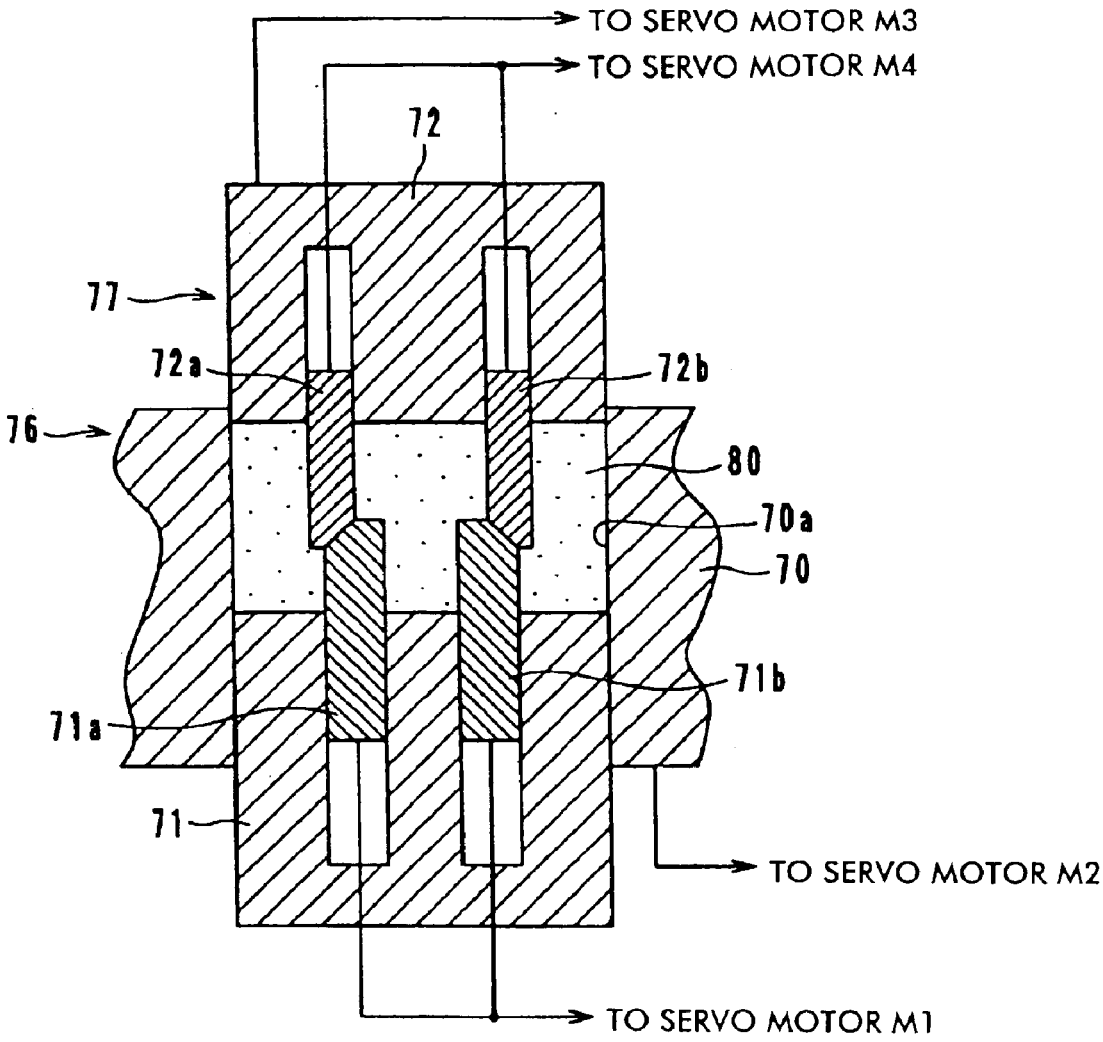
FIG. 5 is a schematic vertical sectional view illustrating a process subsequent to the process shown in FIG. 4.

As shown in FIG. 5, with the inclined portions 73 of the upper core bars 72*a* and 72*b* being in contact with the inclined portions 74 of the lower core bars 71*a* and 71*b*, the upper core bars 72*a* and 72*b* and the lower core bars 71*a* and 71*b* are slid toward the lower punch 71 so that no pressure is applied to the dielectric powder 80 within the cavity 70*a*. Subsequently, once the upper core bars 72*a* and 72*b* and the lower core bars 71*a* and 71*b* reach a predetermined position within the cavity 70*a*, the lowering of the upper core bars 72*a* and 72*b* and the lower core bars 71*a* and 71*b* stops.

Figure 6:
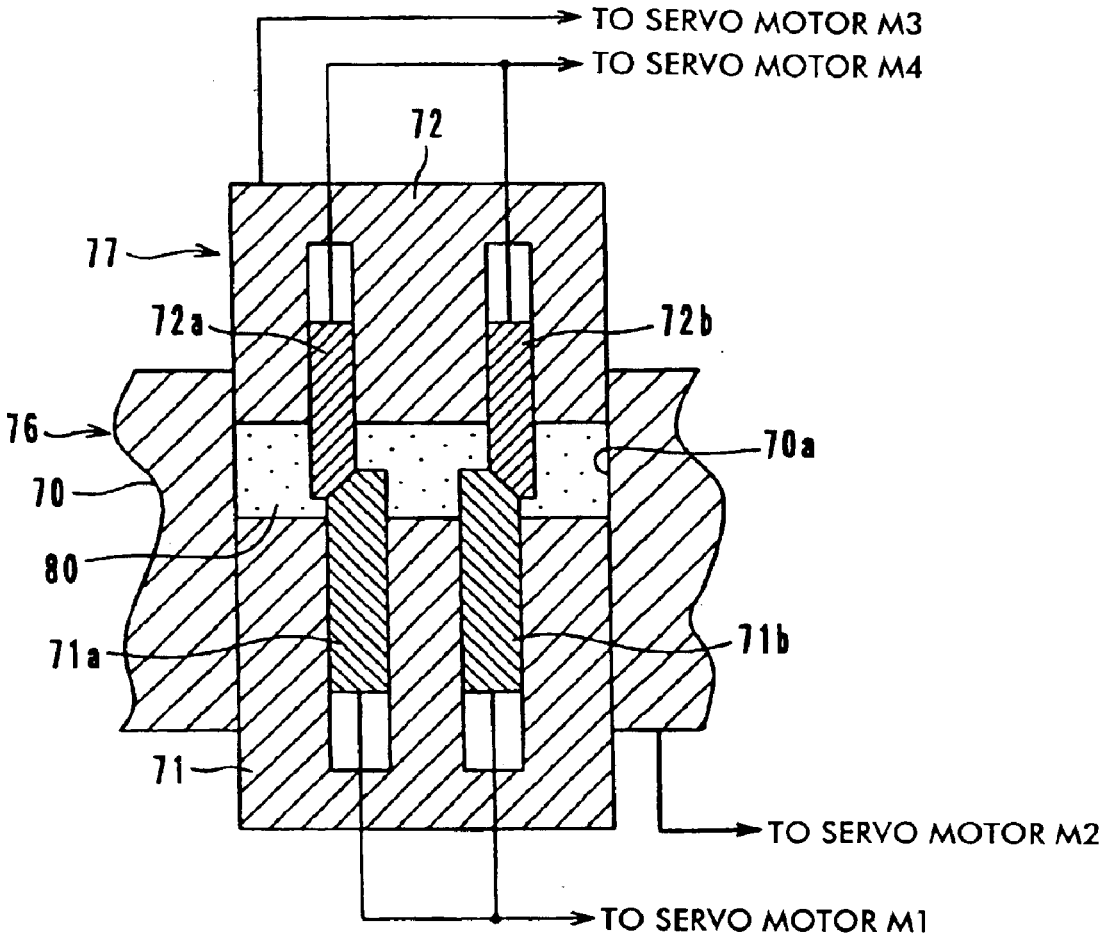
FIG. 6 is a schematic vertical sectional view illustrating a process subsequent to the process shown in FIG. 5.

Next, as shown in FIG. 6, the die 70, the upper punch 72, the lower core bars 71*a* and 71*b*, and the upper core bars 72*a* and 72*b* are moved downward, so that the dielectric powder 80 is compressed under pressure to form the dielectric body 6. In this case, with the inclined portions 73 of the upper core bars 72*a* and 72*b* being in contact with the inclined portions 74 of the lower core bars 71*a* and 71*b*, respectively, the upper core bars 72*a* and 72*b* and the lower core bars 71*a* and 71*b* are slid downward.

Figure 7:
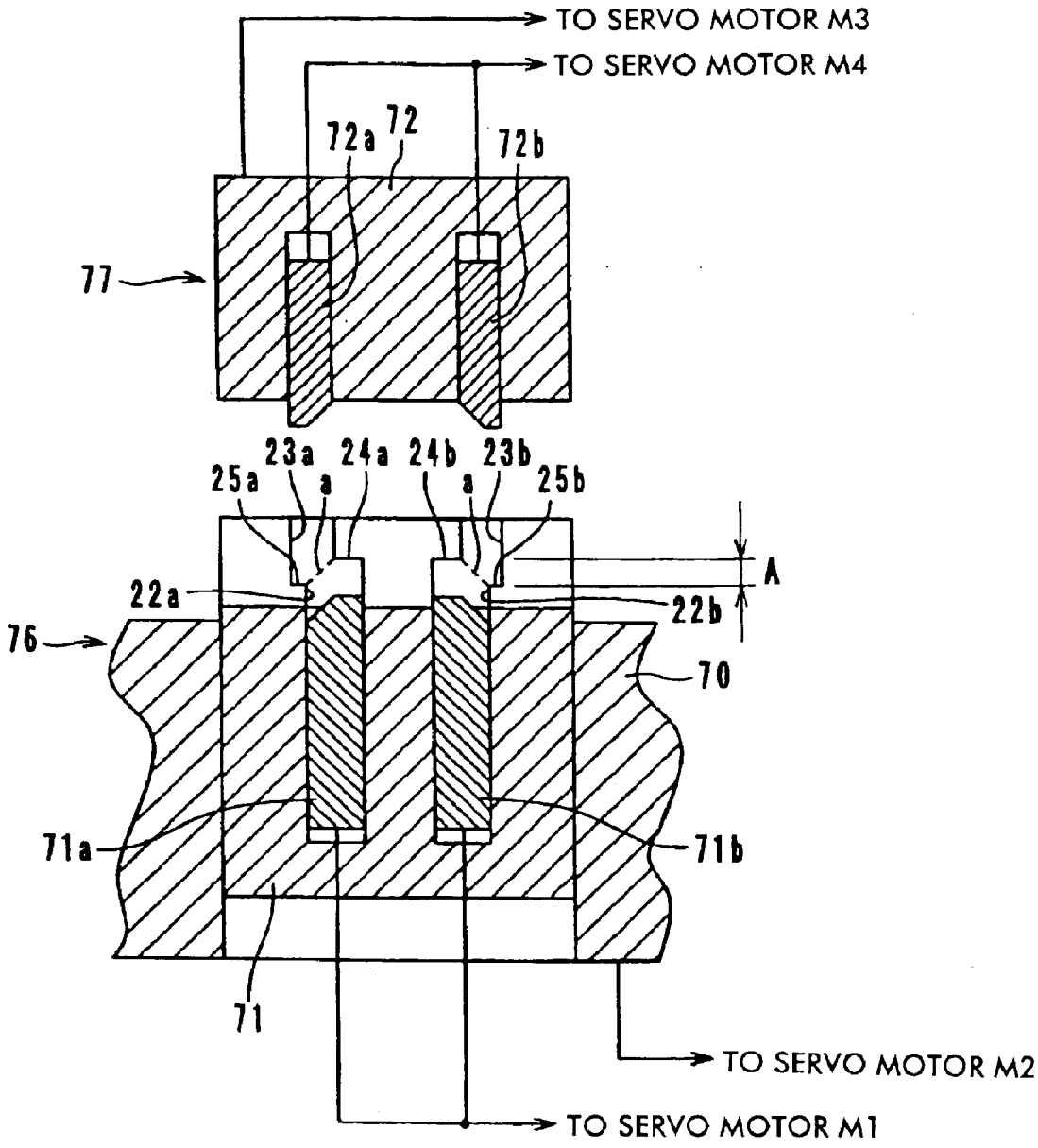
FIG. 7 is a schematic vertical sectional view illustrating a process subsequent to the process shown in FIG. 6.

After the compression is completed, as shown in FIG. 7, the die 70 and the lower core bars 71*a* and 71*b* are moved downward and the upper punch 72 and the upper core bars 72*a* and 72*b* are moved upward, so that a molded dielectric block is removed from therebetween.

As an alternative method for the formation, after molding a dielectric block by compressing under pressure, the opposing surfaces thereof may be machined with large- and small-diameter end mills to form the resonator holes, respectively.

Second Embodiment

Figure 8:
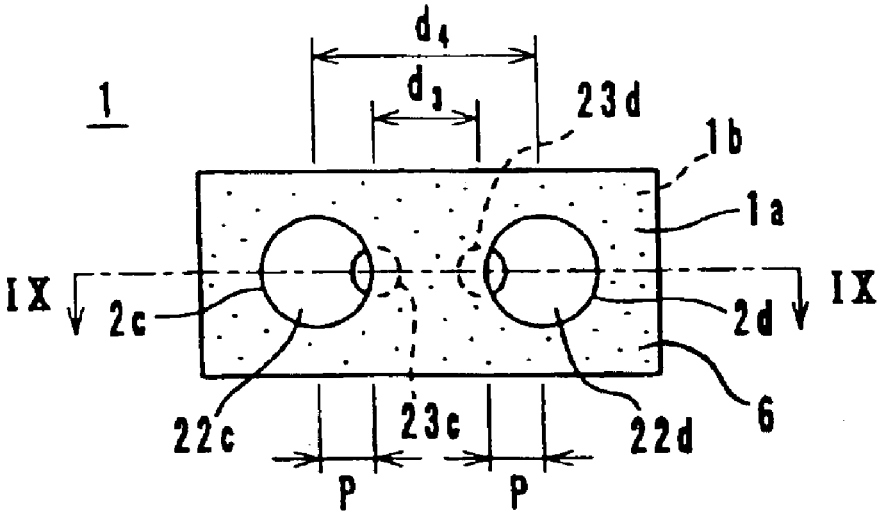
FIG. 8 is a front view of a dielectric filter, viewed from the side of an open-circuited end surface, according to a second embodiment of the present invention.
Figure 9:
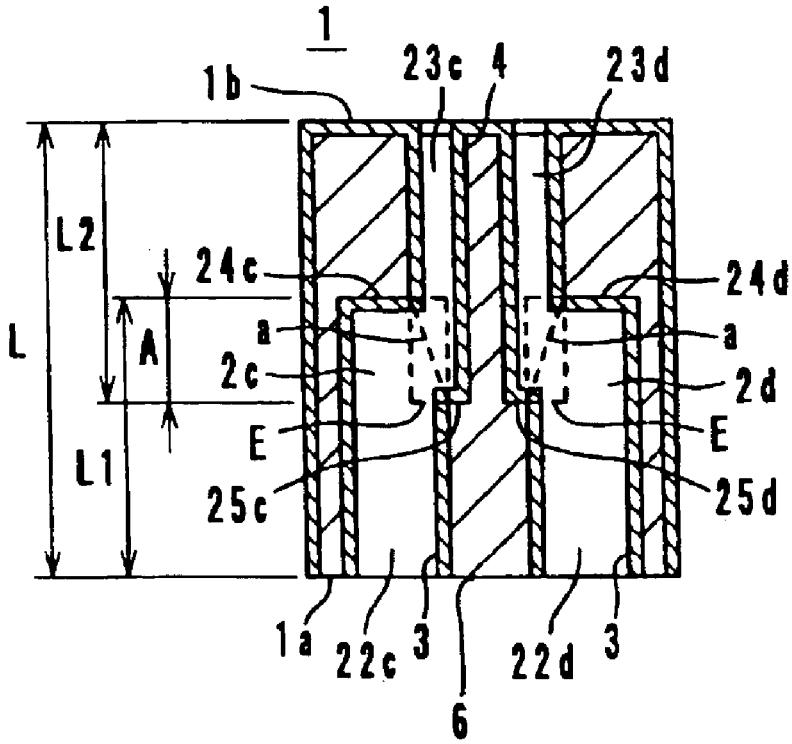
FIG. 9 is a sectional view of the dielectric filter, taken along line IX—IX, according to the second embodiment.

A second embodiment will now be described with reference to FIGS. 8 and 9. In a dielectric filter 1 of the second embodiment, as shown in FIG. 8, the interaxial distance d3 between small-diameter hole portions 23*c* and 23*d* is configured to be smaller than the interaxial distance d4 between large-diameter hole portions 22*c* and 22*d*. In addition, as shown in FIG. 9, the large-diameter hole portions 22*c* and 22*d* and the small-diameter hole portions 23*c* and 23*d* overlap each other in regions indicated by dotted lines E, in the axial directions of the resonator holes 2*c* and 2*d*, respectively. As a result, the connection portions a of the large-diameter hole portions 22*c* and 22*d* and the small-diameter hole portions 23*c* and 23*d* are larger in cross section than the connection portions b of the known dielectric filter (see FIG. 21). Thus, the resonator holes 2*c* and 2*d* have shapes which facilitate the passage of plating liquid therethrough, thereby allowing the formation of the inner conductor 3 on the inner surfaces of the resonator holes 2*c* and 2*d* with sufficient film thickness and stability. As a result, the dielectric filter 1 can improve the Q-value of the resonator.

As shown in FIG. 8, this dielectric filter 1 is configured such that the interaxial distance d3 between the small-diameter hole portions 23*c* and 23*d* at the side of the short-circuited end surface 1*b* (see FIG. 9) is smaller than the interaxial distance d4 between the large-diameter hole portions 22*c* and 22*d*, resulting in an increased electromagnetic field (i.e., magnetic) coupling between the adjacent resonators. With this arrangement, it is possible to provide the dielectric filter 1 having stronger inductive coupling without changing the external shape or the dimensions thereof.

Third Embodiment

Figure 10:
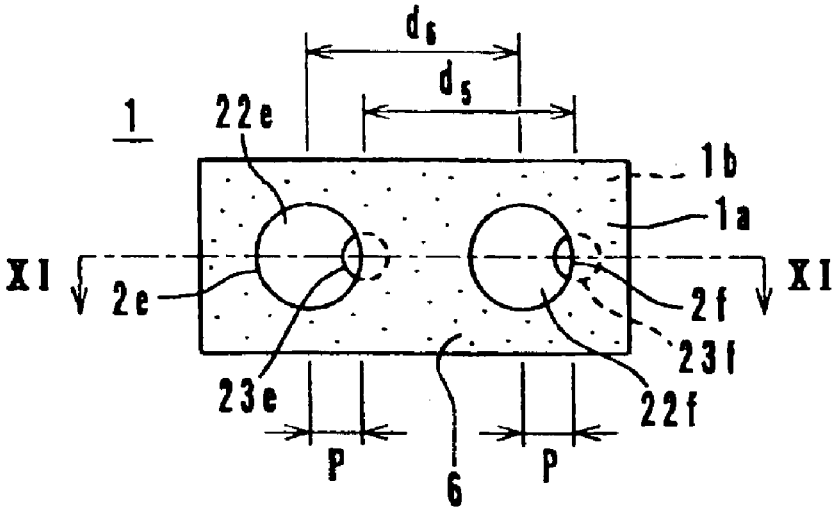
FIG. 10 is a front view of a dielectric filter, viewed from the side of an open-circuited end surface, according to a third embodiment of the present invention.
Figure 11:
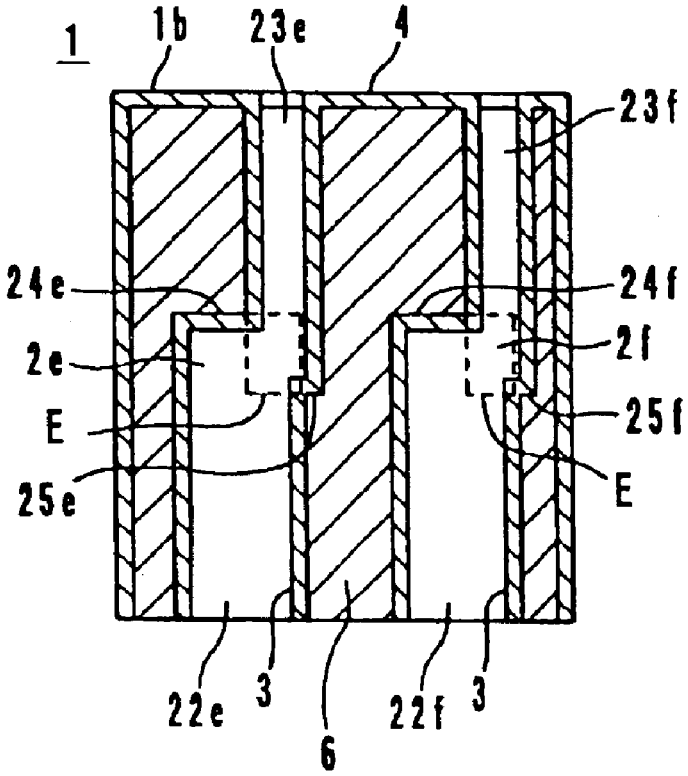
FIG. 11 is a sectional view of the dielectric filter, taken along line XI—XI, according to the third embodiment.

A third embodiment of the present invention will now be described with reference to FIGS. 10 and 11. In a dielectric filter 1 of the third embodiment, as shown in FIG. 10, the interaxial distance d5 between small-diameter hole portions 23*e* and 23*f* is configured to be equal to the interaxial distance d6 between large-diameter hole portions 22*e* and 22*f*. In addition, as shown in FIG. 11, the large-diameter hole portions 22*e* and 22*f* and the small-diameter hole portions 23*e* and 23*f* overlap each other in regions indicated by dotted lines E, in the axial directions of the resonator holes 2*e* and 2*f*, respectively.

Since the dielectric filter 1 according to the third embodiment has a structure similar to those of the first and second embodiments, it offers advantages similar to the dielectric filters thereof. Moreover, this dielectric filter 1 offers more flexibility in designing the degree of electromagnetic field coupling.

Fourth Embodiment

Figure 12:
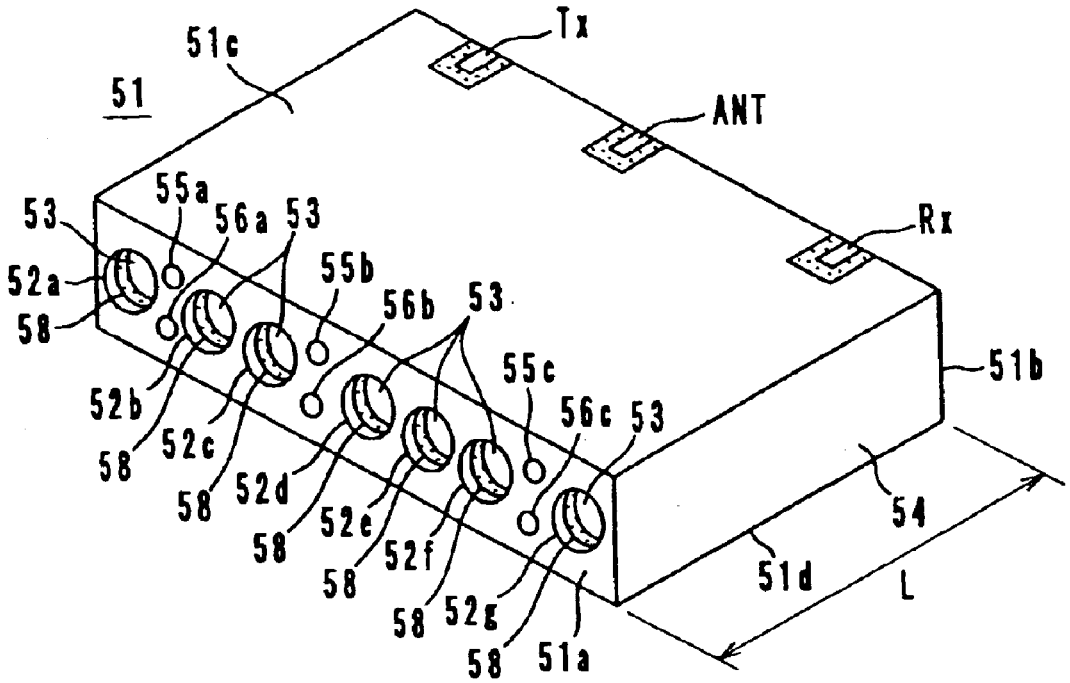
FIG. 12 is a perspective view of a dielectric duplexer according to a fourth embodiment of the present invention.
Figure 13:
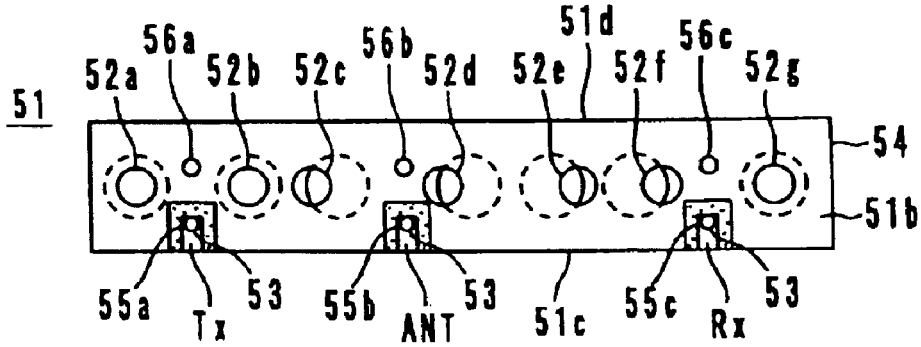
FIG. 13 is a rear view of the dielectric duplexer, viewed from the side of a short-circuited end surface, according to the fourth embodiment of the present invention.
Figure 14:
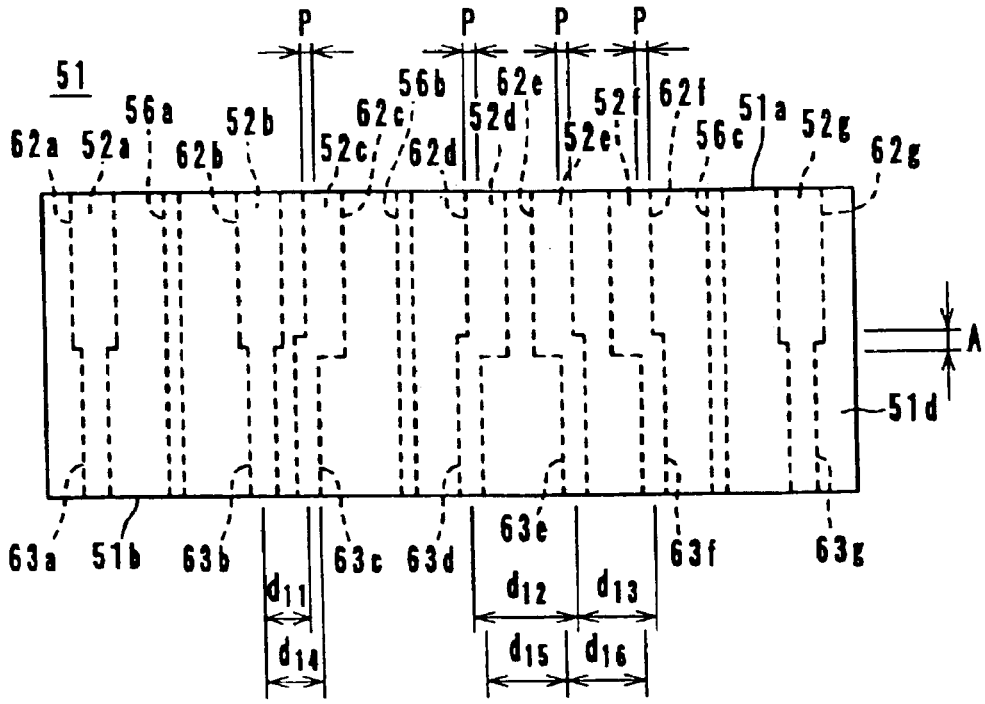
FIG. 14 is a plan view of the dielectric filter according to the fourth embodiment.

A fourth embodiment of the present invention will now be described with reference to FIGS. 12 to 14. The fourth embodiment is directed to a dielectric duplexer for use in a mobile communication device such as a mobile telephone. FIG. 12 is a perspective view of a dielectric duplexer 51, viewed from the side of an open-circuited end surface 51*a*, with the mounting surface (the surface adapted to be surface mounted to a circuit board) 51*c* facing upward. FIG. 13 is a rear view of the dielectric duplexer 51, viewed from the side of a short-circuited end surface 51*b*, with the mounting surface 51*c* facing downward. FIG. 14 is a plan view of the dielectric duplexer 51.

Referring to FIG. 12, the dielectric duplexer 51 has an open-circuited end surface 51*a* and a short-circuited end surface 51*b* which oppose each other and which are generally rectangular. Seven resonator holes 52*a* to 52*g* are also formed in a line so as to extend between the pair of end surfaces 51*a* and 51*b*. An external coupling hole 55*a* and a ground hole 56*a* are formed between the resonator holes 52*a* and 52*b*. Similarly, an external coupling hole 55*b* and a ground hole 56*b*, and an external coupling hole 55*c* and a ground hole 56*c* are formed between the resonator holes 52*c* and 52*d*, and 52*f* and 52*g*, respectively.

Referring to FIG. 14, the resonator holes 52*a* to 52*g* include large-diameter hole portions 62*a* to 62*g* having circular cross-sections, and small-diameter hole portions 63*a* to 63*g* having circular cross-sections and communicating with the large-diameter hole portions 62*a* to 62*g*, respectively. The axes of the small-diameter hole portions 63*c* to 63*f* are displaced from the axes of the large-diameter hole portions 62*c* to 62*f*, respectively, such that the displacement distance P therebetween is within a range which satisfies the relationship $R-r<P<R+r$, where R is the radii of the large-diameter hole portions 62*c* to 62*f* and r is the radii of the small-diameter hole portions 63*c* to 63*f* (i.e., the large and small diameter hole portions overlap one another along their axial directions). Thus, the resonator holes 52*c* to 52*f* have bent shapes.

The interaxial distance d11 between the small-diameter hole portions 63*b* and 63*c* is configured to be smaller than the interaxial distance d14 between the large-diameter hole portions 62*b* and 62*c*. The interaxial distance d12 between the small-diameter hole portions 63*d* and 63*e* is configured to be greater than the interaxial distance d15 between the large-diameter hole portions 62*d* and 62*e*. The interaxial distance d13 between the small-diameter hole portions 63*e* and 63*f* is configured to be equal to the interaxial distance d16 between the large-diameter hole portions 62*e* and 62*f*.

Referring back to FIG. 12, an outer conductor 54 is formed on almost the entire outer surface of the dielectric block in which the dielectric duplexer 51 is formed. A transmitting electrode Tx and a receiving electrode Rx, which serve as input/output electrodes, and an antenna electrode ANT, are formed on the mounting surface 51*c* and extend onto the short-circuited end surface 51*b* of the dielectric duplexer 51 at a predetermined distance from the outer conductor 54 so as to be electrically isolated therefrom.

Respective inner conductors 53 are formed on almost the entire inner surface of each of the resonator holes 52*a* to 52*g*. However, gaps 58 are provided between the inner conductor 53 and the outer conductor 54 at a location near the openings of the large-diameter hole portions 62*a* and 62*g* to provide an open-circuited end of the resonators. The surface 51*b*, in which the openings of the small-diameter hole portions 63*a* to 63*g* are provided, is the short-circuited end surface. The inner conductor 53 is electrically open, i.e., isolated from the outer conductor 54, at the open-circuited end surface 51*a*, and is short-circuited, i.e., directly electrically connected to the outer conductor 54, at the surface 51*b*. In addition, the axial length L of the resonator holes 52*a* to 52*g* is designed to be about $\lambda/4$ ($\lambda$ is the center wavelength of the resonators formed with each of the resonator holes 52*a* to 52*g*).

Respective inner conductors 53 are also formed on the entire inner surface of each of the external coupling holes 55*a*, 55*b*, and 55*c*, and the entire inner surface of each of the ground holes 56*a*, 56*b*, and 56*c*. As shown in FIG. 13, the external coupling holes 55*a*, 55*b*, and 55*c* are electrically connected to the transmitting electrode Tx, the antenna electrode ANT, and the receiving electrode Rx, respectively. Thus, the inner conductor 53 of each of the outer coupling holes 55*a* to 55*c* is electrically connected to the outer conductor 54 at the open-circuited end-surface 51*a*, and is electrically isolated from the outer conductor 54 at the short-circuited end surface 51*b*.

On the other hand, the ground holes 56*a* to 56*c* extend parallel to and adjacent to the outer coupling holes 55*a* to 55*c*. The inner conductors 53 of these ground holes are directly electrically connected to the outer conductor 54 at both the open-circuited end surface 51*a* and the short-circuited end surface 51*b*. Changing the position, shape, and inner dimension (size) of the ground holes 56*a* to 56*c* can cause an increase or decrease in self-capacitance of the external coupling holes 55*a* to 55*c*, thereby allowing for a change in the external coupling so that more appropriate external coupling can be realized. The self-capacitance of the external coupling holes 55*a* to 55*c* herein refers to the capacitance that is generated between the inner conductor 53 of the outer coupling holes 55*a* to 55*c* and a ground conductor (the outer conductor 54 and the inner conductor 53 of the ground holes 56*a* to 56*c*).

The dielectric duplexer 51 includes: a transmission filter (a band pass filter) consisting of two resonators formed with the resonator holes 52*b* and 52*c*; a receiving filter (a band pass filter) consisting of three resonators formed with the resonator holes 52*d*, 52*e*, and 52*f*; and two traps (band elimination filters) consisting of resonators formed with the resonator holes 52*a* and 52*g* that are located at opposite ends of the dielectric block. The external coupling hole 55*a* and the resonator holes 52*a* and 52*b* adjacent thereto, are electromagnetically coupled, which provides the external coupling. Likewise, the external coupling hole 55*b* and the resonator holes 52*c* and 52*b* adjacent thereto, and also the external coupling hole 55*c* and the resonator holes 52*f* and 52*g* adjacent thereto, are electromagnetically coupled, respectively, which provides the external coupling.

As shown in FIG. 14, in the dielectric duplexer 51 configured as described above, the connection portions of the large-diameter hole portions 62*c* to 62*f* and the small-diameter hole portions 63*c* to 63*f* are larger in cross section than the connection portions of the known art. Thus, the resonator holes 52*c* to 52*f* have shapes which facilitate the passage of plating liquid therethrough, thereby allowing the formation of the inner conductor 53 on the inner surfaces of the resonator holes 52*c* to 52*f* with sufficient film thickness and stability. As a result, the dielectric duplexer 51 can improve the Q-value of the resonator.

Referring back to FIG. 12, while a transmission signal transmitted from a transmission circuit (not shown) to the transmitting electrode Tx is output from the antenna electrode ANT through the transmission filter consisting of the resonator holes 52*b* and 52*c*, a reception signal input from the antenna electrode ANT is output from the receiving electrode Rx to a receiving circuit (not shown) through the receiving filter consisting of the resonator holes 52*d*, 52*e*, and 52*f*. This arrangement provides a stronger inductive coupling between the two resonators formed with the resonator holes 52*b* and 52*c*, so that the coupling between the two resonators formed with the resonators 52*d* and 52*e* results in a stronger capacitive coupling. With this arrangement, it is therefore possible to provide a dielectric duplexer 51 having greater capacitive coupling and inductive coupling without changing the outer shape or the dimensions of the dielectric duplexer 51.

As shown in FIG. 14, the interaxial distance d13 between the small-diameter hole portions 63*e* and 63*f* of the resonator holes 52*e* and 52*f* may be configured to equal the interaxial distance d16 between the large-diameter hole portions 62*e* and 62*f*. In this case, without increasing the outer dimensions of the dielectric duplexer, the degree of electromagnetic field coupling between two resonators formed with the resonator holes 52*e* and 52*f* can be kept constant, thereby allowing for an enhanced versatility of design.

In addition, an attenuation pole formed toward a lower pass band (or higher pass band) can be shifted toward further lower frequency (or higher frequency). This arrangement, therefore, can broaden the pass band of the dielectric duplexer 51 and can facilitate the achievement of the small-sized dielectric duplexer 51 having an acute attenuation characteristic and high performance.

Fifth Embodiment

A communication device according to a fifth embodiment of the present invention will be described below in the context of a portable telephone.

Figure 15:
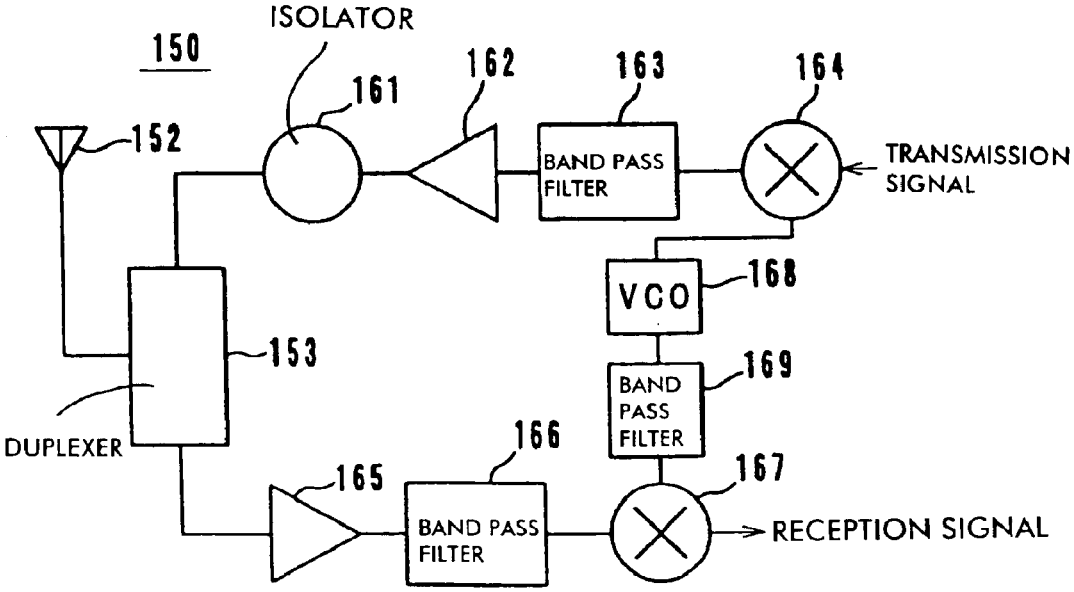
FIG. 15 is a block circuit diagram of a communication device according to a fifth embodiment of the present invention.

FIG. 15 is a block circuit diagram illustrating an RF portion of a portable telephone 150. In FIG. 15, the reference numeral 152 indicates an antenna element, 153 is a duplexer, 161 is a transmission isolator, 162 is a transmission amplifier, 163 is a transmitting interstage bandpass filter, 164 is a transmitting mixer, 165 is a receiving amplifier, 166 is a receiving interstage bandpass filter, 167 is a receiving mixer, 168 is a voltage controlled oscillator (VCO), and 169 is a local bandpass filter.

In this case, for example, the dielectric duplexer of the fifth embodiment described above can, by way of example, be used as the duplexer 153. The dielectric filters 1 of the first to third embodiments can also, by way of example, be used as the transmitting interstage bandpass filter 163, the transmitting interstage bandpass filter 166, and the local bandpass filter 169. Thus, the use of the dielectric duplexer 51 or the dielectric filter 1 can achieve a portable telephone having improved electric characteristics.

Other Embodiments

The dielectric filter, dielectric duplexer, and communication device according to the present invention are not limited to the embodiments described above, and can take various forms without departing from the spirit and scope of the present invention.

Figure 16:
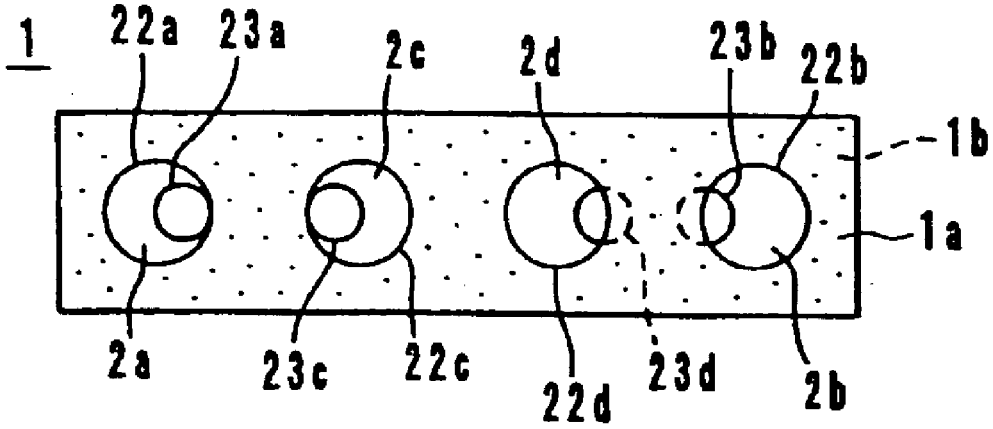
FIG. 16 is a front view of a dielectric filter according to another embodiment of the present invention.

For example, as shown in FIG. 16, four resonator holes 2*a*, 2*b*, 2*c*, and 2*d* may be provided in the dielectric filter 1. In this case, for the resonator holes 2*a* and 2*c*, the axes of the small-diameter hole portions 23*a* and 23*c* are displaced from the axes of the large-diameter hole portions 22*a* and 22*c*, respectively, such that the displacement distance P is within a range which satisfies the relationship $0<P<R-r$, where R is the radii of the large-diameter hole portions 22*a* and 22*c* and r is the radii of the small-diameter hole portions 23*a* and 23*c*. For the resonator holes 2*b* and 2*d*, the axes of the small-diameter hole portions 23*b* and 23*d* are displaced from the axes of the large-diameter hole portions 22*b* and 22*d*, respectively, such that the displacement distance P is within a range which satisfies the relationship $R-r<P<R+r$, where R is the radii of the large-diameter hole portions 22*b* and 22*d* and r is the radii of the small-diameter hole portions 23*b* and 23*d*.

In addition, the large-diameter hole portions 22*b* and 22*d* and the small-diameter hole portions 23*b* and 23*d* overlap each other in the axial directions of the resonator holes 2*b* and 2*d*, respectively. Thus, connection portions of the large-diameter hole portions 22*b* and 22*d* and the small-diameter hole portions 23*b* and 23*d* are larger in cross section than the connection portions of the known dielectric filter. Thus, the resonator holes 2*b* and 2*d* have shapes which facilitate the passage of plating liquid therethrough, thereby allowing the formation of the inner conductor 3 on the inner surfaces of the resonator holes with sufficient film thickness and stability. As a result, this can improve the Q-value of the resonator.

Strong inductive coupling is provided between the two resonators formed with the resonator holes 2*a* and 2*c*, and strong capacitive coupling is provided between two resonators formed with the resonator holes 2*c* and 2*d*. In addition, an even stronger degree of inductive coupling is provided between two resonators formed with the resonator holes 2*b* and 2*d* than that between the resonator holes 2*a* and 2*c*. This can enhance the flexibility in designing electromagnetic coupling of a dielectric filter, thereby facilitating the design of a bandpass filter, duplexer, or the like. Naturally, five or more resonator holes may also be provided.

Figure 17:
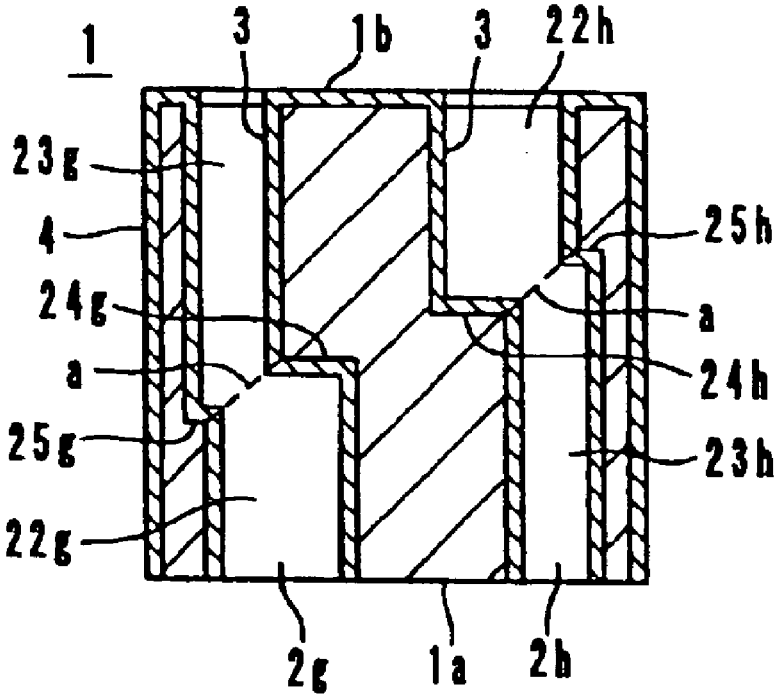
FIG. 17 is a horizontal-section view of a dielectric filter according to another embodiment of the present invention.

In addition, as shown in FIG. 17, large-diameter hole portions 22*g* and 22*h* and small-diameter hole portions 23*g* and 23*h* of the resonator holes 2*g* and 2*h* may be positioned such that the large-diameter hole portion 22*g* is located at the open-circuited end surface 1*a*, the small-diameter hole portion 23*g* is at the short-circuited end surface 1*b*, the small-diameter hole portion 23*h* is at the open-circuited end surface 1*a*, and the large-diameter hole portion 22*h* is at the short-circuited end surface 1*b*.

Figure 18:
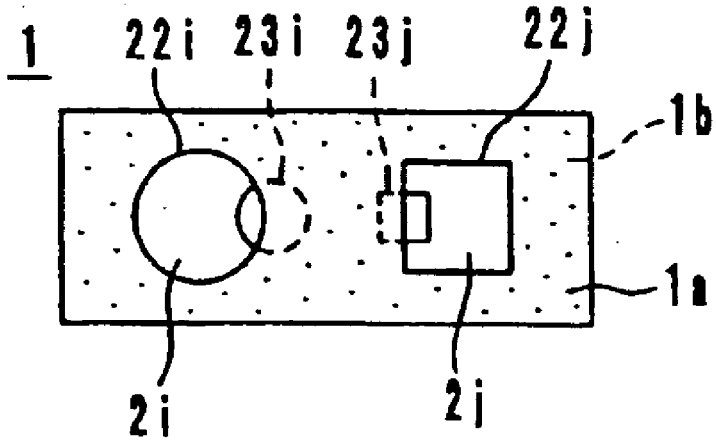
FIG. 18 is a front view of a dielectric filter according to still another embodiment of the present invention.

Optionally, as shown in FIG. 18, large-diameter hole portions 22*i* and 22*j* and small-diameter hole portions 23*i* and 23*j* of resonator holes 2*i* and 2*j* may have rectangular cross-sections, in addition to or instead of the circular shapes. More generally, the cross-section of the large and small diameter hole portions can take various shapes (e.g., round, square or oblong).

Figure 19:
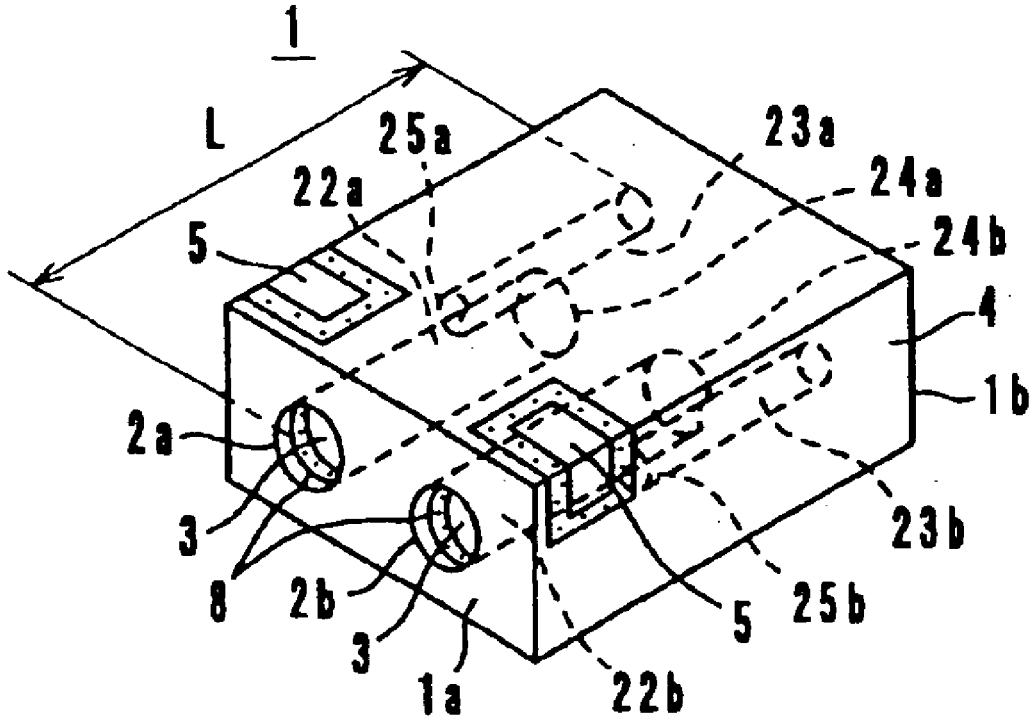
FIG. 19 is a perspective view of a dielectric filter according to yet another embodiment of the present invention.
Figure 20:
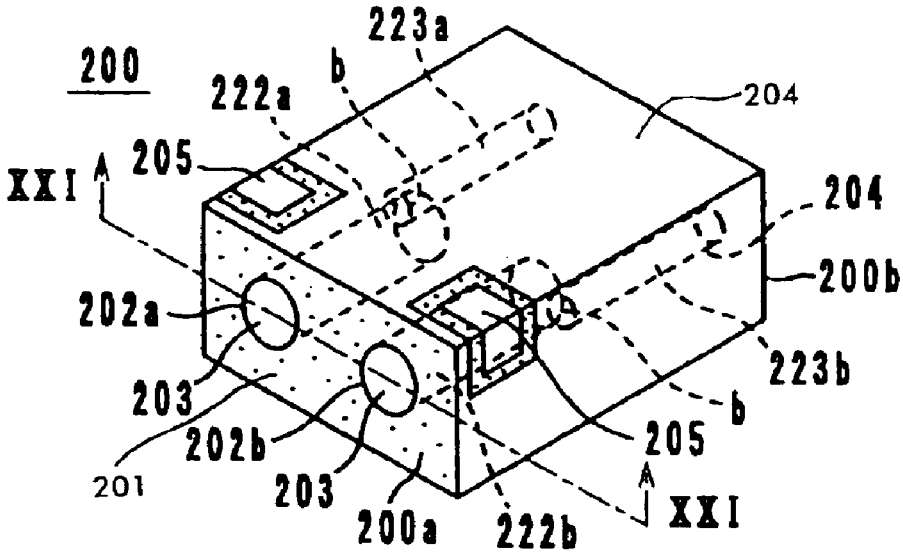
FIG. 20 is a perspective view of a dielectric filter of known art.

Alternatively, a dielectric filter shown in FIG. 19 may be used. In this dielectric filter, the outer conductor 4 is formed on almost the entire outer surface of the dielectric block in which the dielectric filter is formed. The pair of input/output electrodes 5 is formed on the outer surface of the dielectric filter 1 at a predetermined distance from the outer conductor 4 and is electrically isolated therefrom. The inner conductor 3 is formed on almost the entire inner surface of each of resonator holes 2*a* and 2*b*, and the gaps 8 are provided between the inner conductor 3, and the outer conductor 4 formed at the openings of the large-diameter hole portions 22*a* and 22*b*. In this case, the surface 1*a*, in which the gaps 8 and the openings of the large-diameter hole portions 22*a* and 22*b* are provided, is the open-circuited end surface. The surface 1*b*, in which the openings of the small-diameter hole portions 23*a* and 23*b* are provided, is the short-circuited end surface. The large-diameter hole portions 22*a* and 22*b* and the small-diameter hole portions 23*a* and 23*b* overlap each other in the axial directions of the resonator holes 2*a* and 2*b*.

The axial length of the resonator holes is not limited to about $\lambda/4$, and may be, for example, about $\lambda/2$. In such a case, both of surfaces in which openings of the resonator holes are provided must be set as either short-circuited end surfaces or open-circuited end surfaces.

In the resonator holes 2*a* and 2*b* shown in FIG. 3, the positions of the overlapping lengths A of the end walls 24*a* and 24*b* of the large-diameter hole portions 22*a* and 22*b* between the end walls 25*a* and 25*b* of the small-diameter hole portions 23*a* and 23*b* may be displaced from each other in the axial directions of the resonator holes 2*a* and 2*b*, respectively. In other words, the resonator holes (in this case, 2*a* and 2*b*) do not necessarily have to be arranged at the same positions in the axial directions as in the embodiments described above. That is, as long as the large-diameter hole portion 22*a* and the small-diameter hole portion 23*a* overlap each other in the axial directions of the resonator holes 2*a*, the length of the large-diameter hole portion 22*a* (the distance from the open-circuited end surface 1*a* to the end wall 24*b*) and the length of the large-diameter hole portion 22*b* (the distance from the open-circuited end surface 1*a* to the end wall 24*b*) may be different from each other. Likewise, as long as the large-diameter hole portion 22*b* and the small-diameter hole portion 23*b* overlap each other in the axial directions of the resonator holes 2*b*, the length of the small-diameter hole portion 23*a* (the distance from the short-circuited end surface 1*b* to the end wall 25*a*) and the length of the small-diameter hole portion 23*b* (the distance from the short-circuited end surface 1*b* to the end wall 25*b*) may be different from each other.

In addition, the dielectric filter or the dielectric duplexer may have resonator holes having uniform inner diameters but are formed of first and second sections whose central axis are displaced from one another. Furthermore, other electromagnetic field coupling means, such as a coupling groove, may be concurrently provided in the dielectric block to further increase the degree of the coupling between resonator holes.

While the description has been made in each of the first to fourth embodiments in conjunction with the resonator holes with the large-diameter hole portions provided in the open-circuited end surface and the small-diameter hole portions provided in the short-circuited end surface, the present invention is not limited to thereto. Thus, the large-diameter hole portions may be provided in the short-circuited end surface and the interaxial distance between the small-diameter hole portions in the open-circuited end surface may be altered. In this case, the coupling relationship of two adjacent resonator holes will be opposite to that of the embodiment described above. That is, the degree of capacitive coupling is gradually increased as the interaxial distance between the small-diameter hole portions is decreased, while the degree of inductance coupling is increased as the interaxial distance between the small-diameter hole portions is increased.

While a description has been given in each of the first to fourth embodiment described above in conjunction with the dielectric filter or the dielectric duplexer in which the input/output electrodes are formed at a predetermined position on the outer surface of the dielectric block, the present invention is not limited thereto. For example, the input/output electrodes may be replaced with resin pins for providing connection with an external circuitry.

While, in the first to fourth embodiments, a description has been given in conjunction with the case in which the axes of the small-diameter hole portions are displaced from the axes of the large-diameter hole portions that are arranged at a predetermined distance, the present invention is not necessarily limited thereto. Thus, the axes of the large-diameter hole portions may be displaced from the axes of the small-diameter hole portions that are arranged at a predetermined distance.

While, in the first to fourth embodiments, the axes of the large-diameter hole portions and the axes of the small-diameter hole portions are arranged in a line, the axes of the large-diameter hole portions and the axes of the small-diameter hole portions may be arranged, for example, in a vertical zigzag in the dielectric block.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for manufacturing a dielectric filter comprising:

providing a dielectric block which has a plurality of resonator holes therein, at least one of the resonator holes being a bent resonator hole comprising a large-diameter hole portion and a small-diameter hole portion communicating with the large-diameter hole portion, a central axis of the large-diameter hole portion and a central axis of the small-diameter hole portion and the small-diameter hole portion overlapping each other in their axial directions; and forming a respective inner conductor on the inner surface of each of the resonator holes, and an outer conductor on the outer surface of the dielectric block.

2. A method according to claim 1, further comprising forming the bent resonator hole in the dielectric block by providing a first die having a shape corresponding to the large-diameter hole portion and a second die having a shape corresponding to the small-diameter hole portion, the first and second dies having correspondingly inclined first ends, and causing the inclined first ends to abut in the interior of the dielectric block.

3. A method according to claim 2, wherein the dielectric block is formed by press molding in a press mold and the first and second dies are slideable relative to portions of the press mold.

4. A method according to claim 3, wherein the provided dielectric block has two adjacent bent resonator holes formed in the provided dielectric block such that the interaxial distance between the small-diameter hole portions of the two adjacent bent resonator holes is greater than the interaxial distance between the large-diameter hole portions thereof.

5. A dielectric duplexer comprising a dielectric filter manufactured by the method according to claim 4.

6. A communication device comprising a dielectric filter manufactured by the method according to claim 4.

7. A communication device comprising a dielectric filter manufactured by the method according to claim 4.

8. A dielectric duplexer comprising a dielectric filter manufactured by the method according to claim 3.

9. A communication device comprising a dielectric filter manufactured by the method according to claim 3.

10. A communication device comprising a dielectric filter manufactured by the method according to claim 3.

11. A method according to claim 2, wherein the provided dielectric block has two adjacent bent resonator holes formed in the provided dielectric block such that the interaxial distance between the small-diameter hole portions of the two adjacent bent resonator holes is greater than the interaxial distance between the large-diameter hole portions thereof.

12. A dielectric duplexer comprising a dielectric filter manufactured by the method according to claim 11.

13. A dielectric duplexer comprising a dielectric filter manufactured by the method according to claim 2.

14. A communication device comprising a dielectric filter manufactured by the method according to claim 2.

15. A method according to claim 1, wherein the provided dielectric block has two adjacent bent resonator holes formed in the provided dielectric block such that the inter axial distance between the small-diameter hole portions of the two adjacent bent resonator holes is greater than the interaxial distance between the large-diameter hole portions thereof.

16. A dielectric duplexer comprising a dielectric filter manufactured by the method according to claim 15.

17. A dielectric duplexer comprising a dielectric filter manufactured by the method according to claim 1.

18. A communication device comprising a dielectric filter manufactured by the method according to claim 1.

* * * * *